US006625852B1

(12) United States Patent
Hanson

(10) Patent No.: US 6,625,852 B1
(45) Date of Patent: Sep. 30, 2003

(54) CASKET

(75) Inventor: Wayne D. Hanson, Tucson, AZ (US)

(73) Assignee: Wayne Hanson, Tucson, AZ (US)

( * ) Notice: Subject to any disclaimer, the term of this patent is extended or adjusted under 35 U.S.C. 154(b) by 237 days.

(21) Appl. No.: 09/721,187

(22) Filed: Nov. 21, 2000

(51) Int. Cl.[7] ..... A61G 17/00
(52) U.S. Cl. ..... 27/2; 5/105
(58) Field of Search ..... 27/2, 14, 17; 5/101, 5/105, 107

(56) References Cited

U.S. PATENT DOCUMENTS

| | | | | | |
|---|---|---|---|---|---|
| 27,964 | A | * | 4/1860 | Brooks | 297/1 |
| 385,633 | A | * | 7/1888 | Kelly et al. | 5/105 |
| 855,551 | A | * | 6/1907 | Avara | 5/97 |
| 1,203,080 | A | * | 10/1916 | Vanek | 5/97 |
| 1,461,458 | A | * | 7/1923 | Robinson | 280/31 |
| 1,527,793 | A | * | 2/1925 | Froelich | 5/107 |
| D141,294 | S | * | 5/1945 | Woron | |
| 2,775,021 | A | * | 12/1956 | Bourgraf | 27/6 |
| 3,172,183 | A | * | 3/1965 | Bugg | 27/7 |
| 3,335,433 | A | * | 8/1967 | Stopek | 5/105 |
| 3,797,054 | A | * | 3/1974 | Sly | 5/101 |
| 4,021,867 | A | * | 5/1977 | Maxwell, Jr. | 5/106 |
| 4,139,929 | A | * | 2/1979 | Angermann | 27/35 |
| D253,975 | S | | 1/1980 | Branson | |
| 4,205,876 | A | * | 6/1980 | Cetina | 297/118 |
| 4,265,006 | A | * | 5/1981 | Angermann | 27/14 |
| 4,337,556 | A | | 7/1982 | Winburn et al. | |
| 4,372,018 | A | | 2/1983 | Miller, IV | |
| D273,154 | S | | 3/1984 | Almela | |
| D346,263 | S | | 4/1994 | Erickson | |
| D418,657 | S | | 1/2000 | Lamolinara | |

FOREIGN PATENT DOCUMENTS

GB 2346137 A * 8/2000

OTHER PUBLICATIONS

Cherokee Child Caskets Brochure pp. 1–11, front and back cover, two page price list "Effective Jan. 23, 2000" Not admitted as "prior art" due to date considerations.

Tomorrow's Cradle www.zwislerbros.com/casket.htm Home page (2 pp.), Features (2 pp.) Photos (2 pp.) Order Form (2 pp.) "Last Modified Mar. 1, 2000" Not admitted as "prior art" due to date considerations.

* cited by examiner

*Primary Examiner*—William L. Miller
(74) *Attorney, Agent, or Firm*—Beem Patent Law Firm

(57) ABSTRACT

A casket includes a repository for receiving a body for viewing and burial. The repository includes a bottom, a front wall with a top, a rear wall and two end walls, wherein at least one of the end walls has a riser extending upwardly from the one end wall, the riser having a top which is higher than the top of the front wall, and a cover adapted to fit over the riser top and to cover the repository.

10 Claims, 9 Drawing Sheets

CASKET

BACKGROUND AND OBJECTS OF THE INVENTION

The present invention relates to burial caskets.

Traditionally, the body of a deceased is placed within a burial casket, which may be of a decorative nature, and which may be open for viewing of the body during a funeral service prior to closing of the casket for burial. The funeral service serves an important psychological function for the friends, relatives and other survivors of the deceased, in that it allows the survivors to come to grips with the loss of a loved one, as part of a grieving process.

Of particular poignancy is the passing of infants. Perhaps even more so than with other funerals, it is important for family members and friends to view the deceased infant in an appropriately sized and styled burial casket during a funeral service as part of the natural and necessary grieving process. After an open casket service, the casket is closed and, typically, the father of the infant, followed by other members of the immediate family, carries the closed casket from the committal area to the gravesite, in most instances lowering the casket directly into a concrete burial vault, which in the case of infant burials, generally is positioned about two feet below ground. In order to be appropriate for such transport, it is important that an infant burial casket have a secure closure and that it be light in weight and compact in dimensions.

Until now, the burial caskets provided for infants typically have been simply smaller versions of adult caskets. Typical infant caskets are as shown in a recent brochure of Cherokee Casket Company.

Thus, infant and child caskets, as with adult caskets, typically have been variations on a traditional "pine box" having a bottom, four walls, and a hinged lid, as shown in the Cherokee Child Casket brochure as Model No. 80 Orthodox. Whether the traditional casket is of wood (typically pine, presswood or fiberboard), metal, or other material, whether it is decorated with hardware or other decorative features, whether the corners are square, rounded or mitered, whether the casket is covered in fabric, it will be recognized that in all of its variations, the casket has been simply a variation on the pine box. Thus, the traditional casket has lacked an appearance of repose and peace, giving rise to a long felt need, particularly in the case of infant funerals and burials.

Many modern cemeteries have endeavored to serve the public and more particularly the families aggrieved by the loss of infant children by providing a babyland section in which valuable cemetery space is provided free of charge to the family for infant burial, however, the typical standard infant burial vault (usually made of concrete and placed within a grave for the receipt of the usually less-durable casket) is of limited size, typically having inside dimensions of about 15 inches deep×39 inches long×16 ¼ inches wide. The small size of the typical standard infant burial vault limits the size of infant caskets suitable for such vaults. Alternatively, but generally undesirably, larger infant caskets result in the need for purchase of expensive and perhaps less appropriate adult cemetery space and adult burial vaults.

Moreover, in many traditional burial caskets, the positioning of a body within the casket for suitable viewing during a funeral service involves the manipulation of a mattress support by means of an adjustment mechanism at both ends of the casket, in order to elevate the body for viewing during a funeral and to lower the body for closure of the casket for burial, adding greatly to the complexity and expense of the casket. See U.S. Pat. No. 4,337,556 at Column 1, lines 46–52.

Efforts have been made to provide a more attractive casket particularly suitable for infants or pets, such as the infant burial cradle disclosed in U.S. Design Pat. No. 346,263, however, that casket has several deficiencies in that the body cannot easily be displayed for viewing during a funeral service while at the same time permitting ready closure of the casket lid for burial. The casket also lacks rocker-shaped feet to complete the image of a cradle and to lift the casket for better viewing of the body during a funeral service. A traditional cradle, such as that shown in U.S. Design Pat. No. 273,154 is not suitable for use as a casket in either a funeral service or burial because the rockers undesirably permit the casket to rock in a manner unsuitable for a funeral service, the cradle fails to provide a cover for closure and burial and, further, the width and height of the rockers prevent such a cradle from being inserted into a typical standard infant burial vault such as is provided in the babyland section of modern cemeteries.

Other efforts to provide a suitable casket for infant or pet burial are as shown in U.S. Design Pat. Nos. 253,975 and 418,657.

Efforts also have been made to provide caskets having modular components see U.S. Pat. Nos. 4,337,556 and 4,372,018. These caskets, however, are of complex design and require careful inventory and skill in assembling the many components, many of which may be required to be stored for long periods for repeated use and others which are intended for burial.

It is, therefore, an object of the present invention to minimize or obviate problems of the type discussed above and to satisfy the long felt needs in the art.

It is another object of the invention to provide a novel burial casket comprising a repository, for receiving a body, with improved viewing characteristics and appearance and a cover for covering and closing the repository.

An additional object of the invention is to provide a repository having supports comprising legs which in one mode will support and lift the casket into a first or elevated position while in a second mode will permit the repository to rest in a second or unelevated position.

A further object of the invention is to provide a repository having rocker-shaped feet which will provide the appearance of rockers while preventing rocking of the repository and still permitting the repository to fit within a standard burial vault.

A still further object of the invention is to provide a casket comprising a repository for receiving a body and a cover-spacer which in a first mode underlies and supports the repository and in a second mode covers and closes the repository.

SUMMARY OF THE INVENTION

In achieving these objects, the present invention involves a novel burial casket comprising a repository for receiving a body and a cover adapted to cover the repository.

In one aspect of the invention, the repository has a bottom panel, a front wall with a top, a rear wall and two end walls. At least one of the end walls has a riser extending upwardly from the end wall, the riser having a top which is higher than the top of the front wall, thereby providing improved viewing and display characteristics, while the cover is adapted to adjoin the riser top and to cover and close the repository without it being necessary to reposition the body.

In another aspect of the invention, a casket is provided including a repository for receiving a body, a cover adapted to cover and close the repository, and legs underlying the repository which in a first mode may be extended downwardly to lift and support the repository in a first or elevated position and in a second mode may be contracted so that the repository is placed in a second or unelevated position.

In a further aspect of the invention, a casket is provided including a repository for receiving a body and a cover adapted to cover and close the repository, legs for supporting the repository and rocker-shaped feet having upturned ends and each foot having at least two supporting points to prevent rocking.

In still another aspect of the invention, a casket is provided including a repository for receiving a body and a cover-spacer which in a first mode underlies and supports the repository and in a second mode covers and closes the repository.

In yet another aspect of the invention, a casket is provided including a cradle-shaped repository having a bottom, a front wall with a top, a matching rear wall with a top, and two end walls, the two end walls having risers extending upwardly, each riser having a top higher than the tops of the front and rear walls, the bottom having retractable legs terminating in rocker-shaped feet, and a cover-spacer adapted in a first mode to underlie and support the repository in a first or elevated position and in a second mode to adjoin the riser tops and to cover and close the repository.

THE DRAWINGS

The objects and advantages of the invention will become apparent from the following detailed description of a preferred embodiment thereof, in connection with the accompanying drawings in which the numerals designate like elements, and in which.

DETAILED DESCRIPTION OF THE INVENTION

Figure 1:
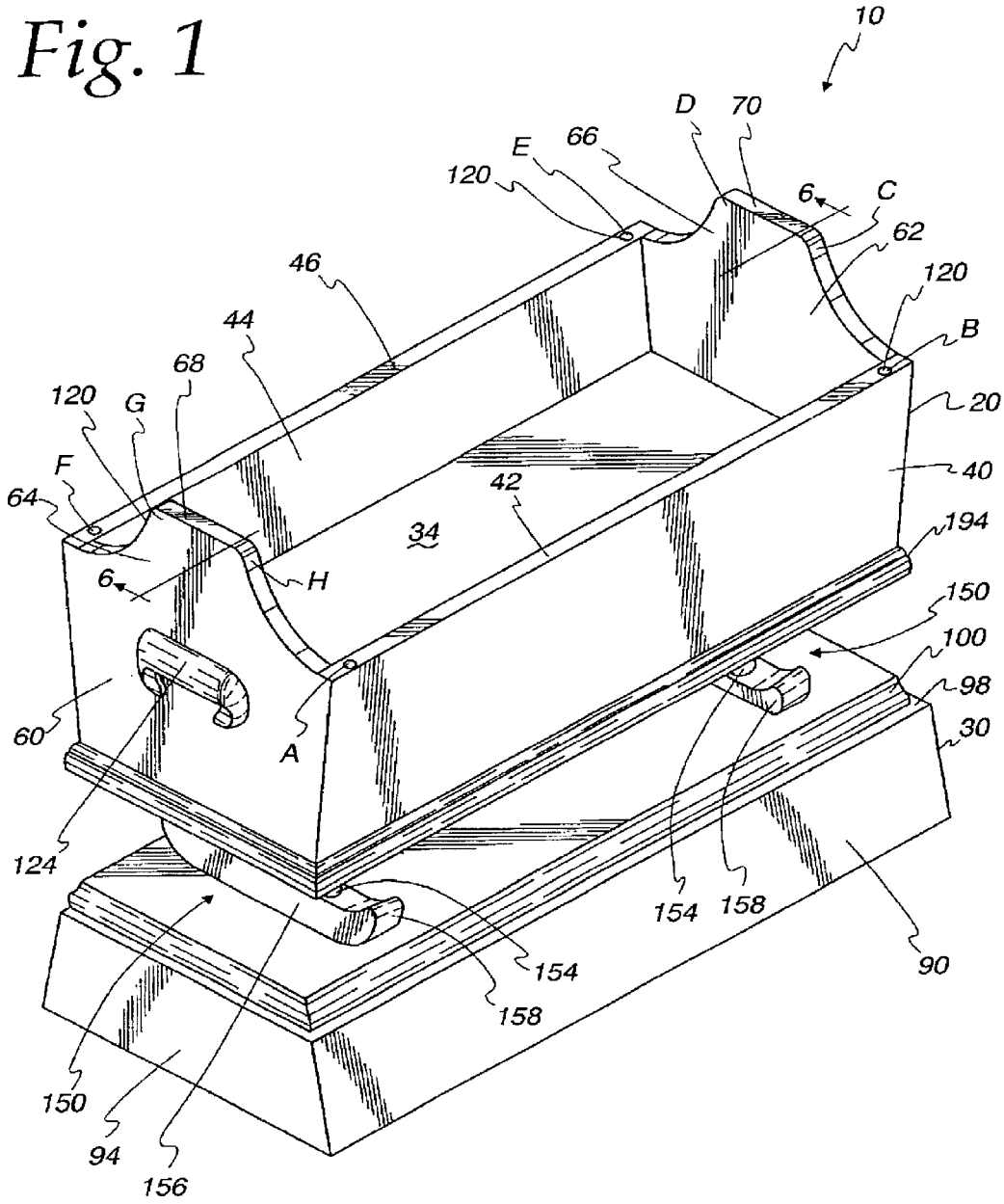
FIG. 1 is a perspective view of a casket shown in a display mode in accordance with the present invention.
Figure 2:
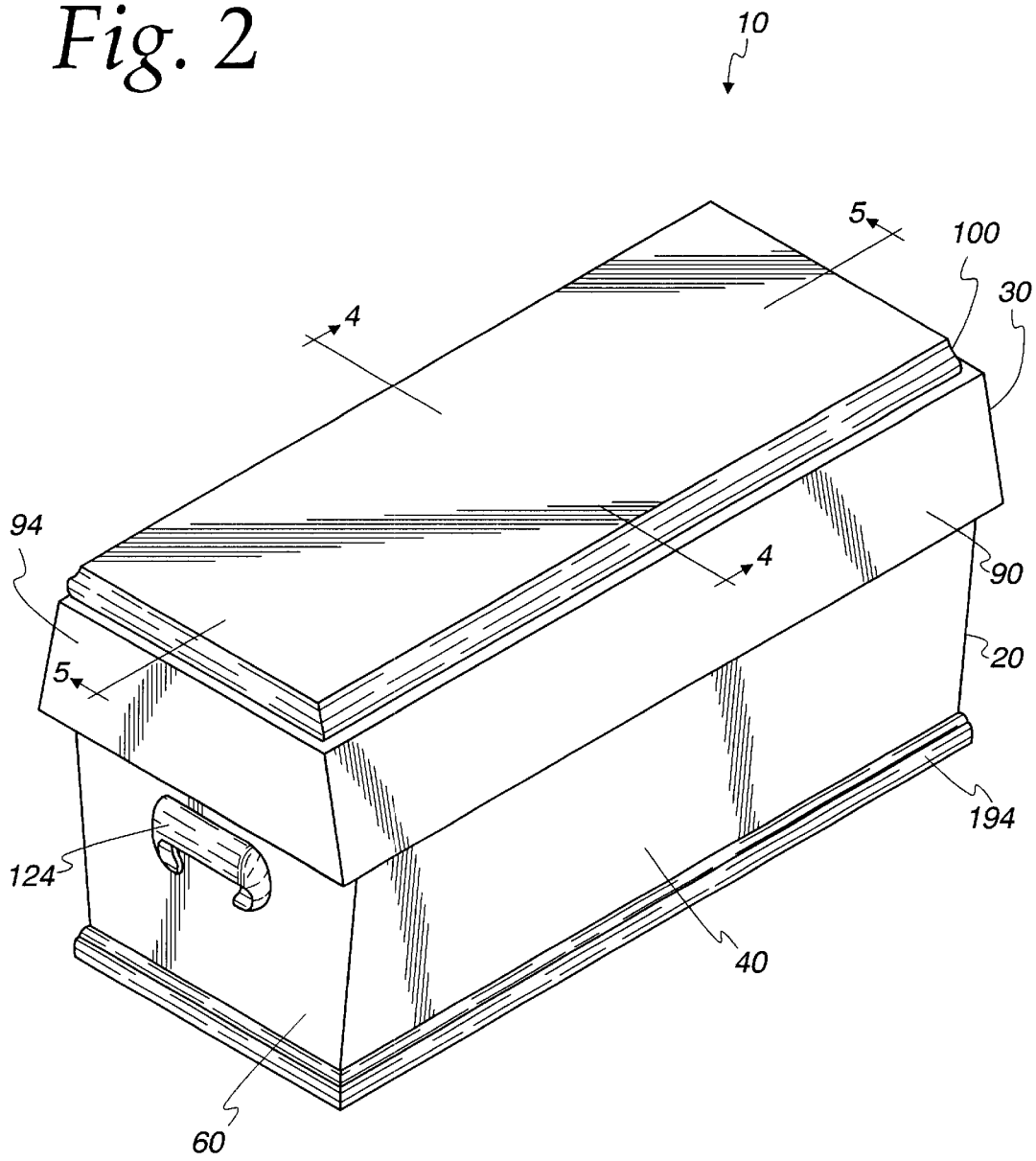
FIG. 2 is a perspective view of a casket shown in a closed mode in accordance with the present invention.
Figure 3:
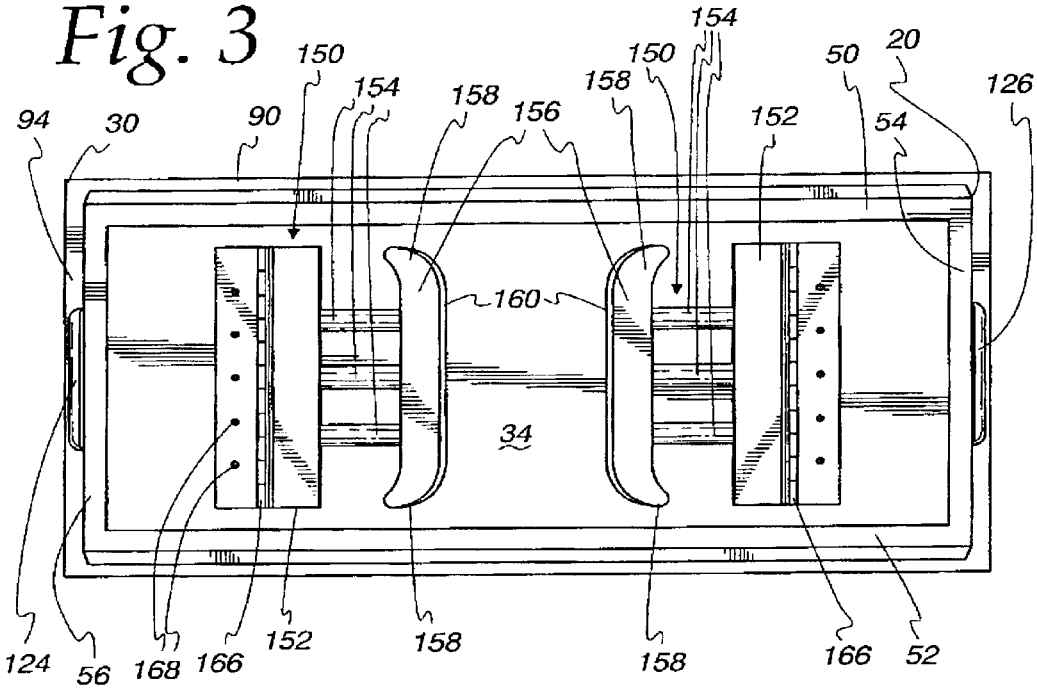
FIG. 3 is a bottom plan view of the closed casket shown in FIG. 2.
Figure 4:
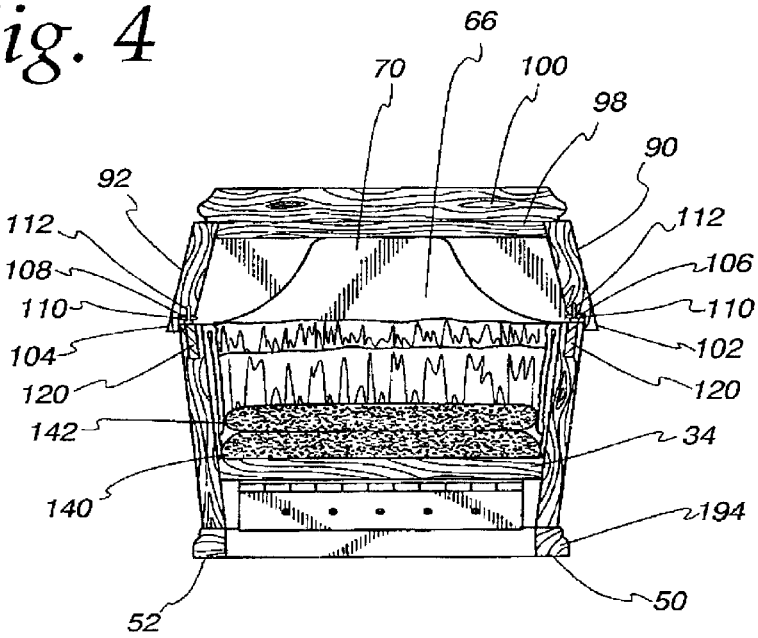
FIG. 4 is a cross-section of the closed casket of FIG. 2 along lines 4—4.
Figure 5:
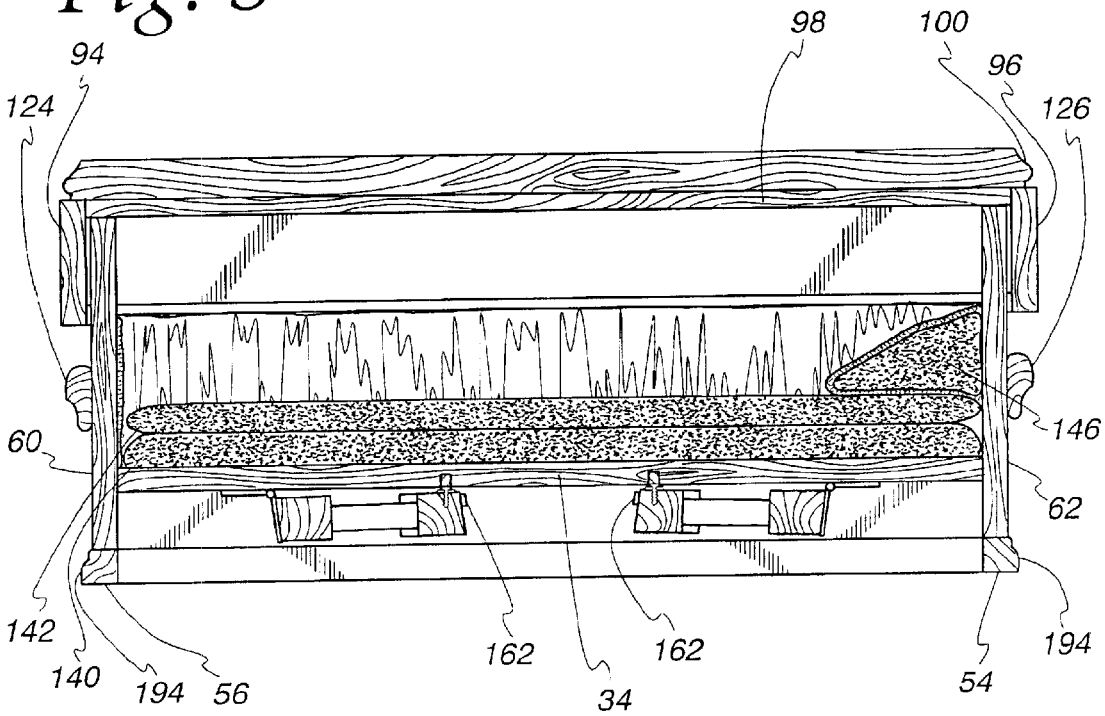
FIG. 5 is a cross-section of the closed casket of FIG. 2 taken along lines 5—5.

A preferred burial casket 10 according to the present invention comprises a repository 20 and a cover or cover-spacer 30. The casket of the invention is suitable for funerals and burial of adults, children or young infants, and also may be used for pets or animals, with variations such as size and proportion as will be apparent to one of ordinary skill in the art when given the teachings herein. In a preferred embodiment, casket 10 is particularly suitable for funerals and burial of infants.

Casket 10 preferably is of two parts and is formed of a suitable material, such as wood, preferably alder (generally and preferably ¾ inch thick unless otherwise specified or shown), and is intended for use in two modes. Preferably, the casket consists of two parts and both parts are used in both modes. Accessories and options can be added without departing from the spirit or scope of the claimed invention.

In a first mode, the casket 10 is intended for use in a funeral service wherein a body of a deceased may be displayed for viewing during the funeral service. In a second mode, the casket 10 is closed, as for burial.

Repository 20, which receives a body of a deceased, preferably has a bottom panel 34 and four walls, namely, a front wall 40 with a top 42, a rear wall 44 with a top 46, and two end walls 60, 62. The walls and the bottom panel preferably arc substantially planar. Front wall 40 and rear wall 44 preferably are slightly inclined from the vertical so that tops 42, 46 are farther apart than bottoms 50, 52. End walls 60, 62 preferably are substantially vertical.

Figure 8:
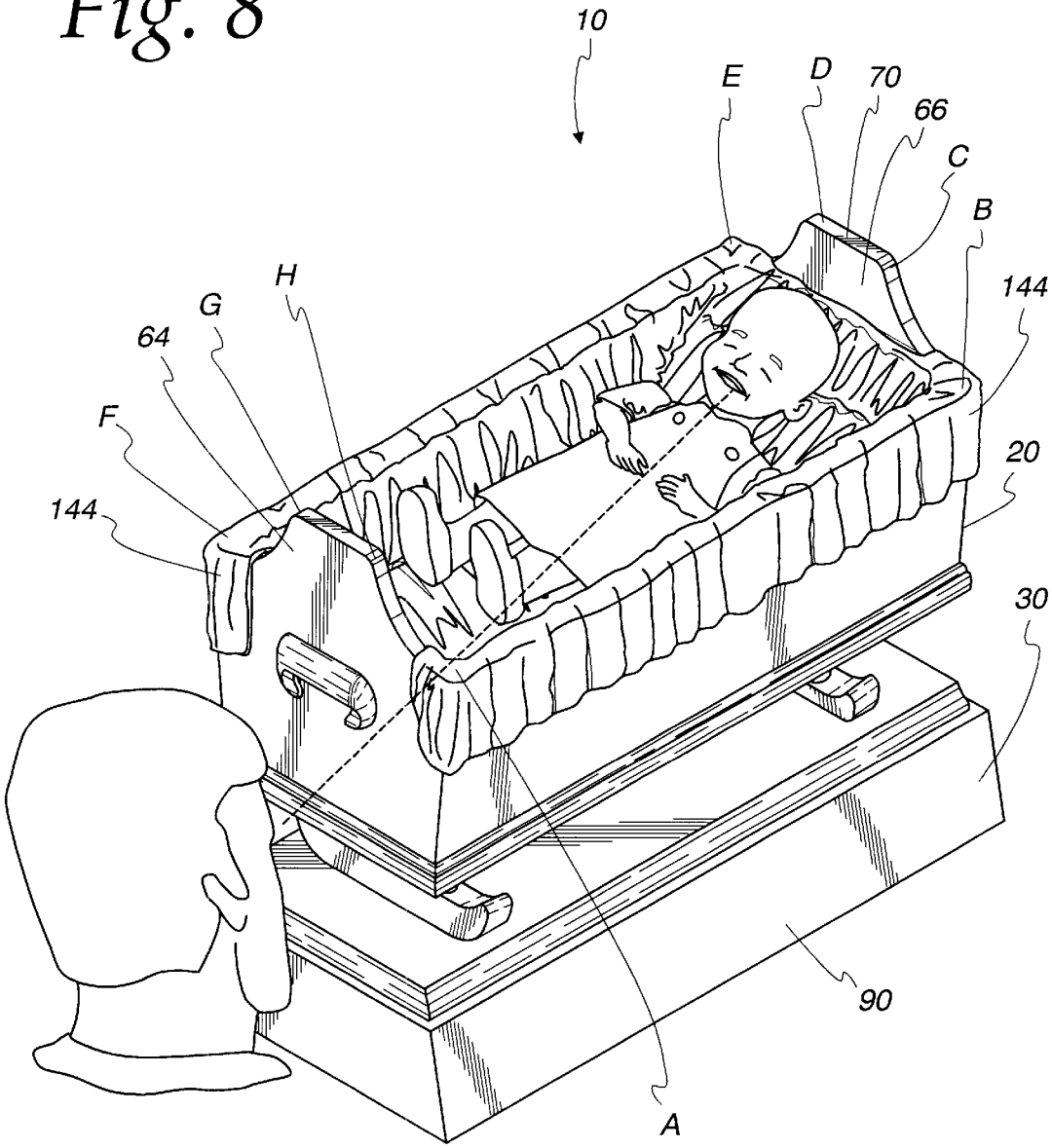
FIG. 8 is a perspective view of the open casket of FIG. 1 showing a line of sight for a viewer.

Preferably, at least one, and still more preferably, both end walls 60, 62 include risers 64, 66 extending upwardly. Each riser 64, 66 has a top 68, 70 which is higher than top 42 of front wall 40, and preferably each riser top also is higher than top 46 of rear wall 44. In a preferred embodiment, repository 20 is symmetrical both end-to-end and front-to-rear and matching risers 64, 66 result in a cradle shape as further developed through the use of other cradle-suggestive features described in greater detail below. Riser 66 may be thought of as a headboard and riser 64 as a footboard, see FIG. 8. Headboard 66 preferably is the same height as footboard 64, but it is also within the scope of the invention for headboard 66 to be higher than footboard 64 or for footboard 64 to be omitted. Preferably, each riser 64, 66 extends about 30% to about 60% higher than front wall top 42. In a preferred embodiment, front wall 40 and rear wall 44 are each about eight inches high, and end walls 60, 62 are about eleven inches high thus risers 64, 66 extend above front wall 40 by about ⅜ of the height of the front wall. The improvement in viewing characteristics is even more apparent when the end wall/front wall comparison is stated in terms of height above bottom panel 34. Riser tops 68, 70 are preferably about nine inches higher than bottom panel 34, or about 50% higher than front wall top 42 and rear wall top 46 which are about six inches above bottom panel 34.

Regarding size of infant caskets, a full term infant typically ranges from 19 inches to 23 inches in length, and an infant casket preferably should accommodate an infant of such length without being too large and disproportionate. The preferred dimensions of an infant-sized repository are about 23 to 27 inches long by about 11 to 13 inches wide by about 10 to 12 inches high. Most preferably, the internal dimension from end wall 60 to end wall 62 is about 24 inches and the internal dimension from front wall top 42 to rear wall top 46 is about 11 inches. The depth of said repository preferably is about eight to ten inches from the end wall tops 68, 70 to the bottom panel 34. Bottom panel 34 preferably is raised about one to two inches above the bottoms 50, 52, 54, 56 of the walls, see FIGS. 3–6.

The cover or cover-spacer 30 is adapted to adjoin each riser top 68, 70 and to slidably cover and close repository 20.

Cover-spacer 30 comprises two longitudinal panels 90, 92, two end panels 94, 96, top panel 98 and crown 100. The panels preferably are substantially planar. Longitudinal panels 90, 92 preferably are inclined slightly outwardly from vertical so that they are further apart at lips 102, 104 than at their junction with top panel 98. End panels 94, 96 preferably are substantially vertical.

Cover-spacer 30 further comprises longitudinal panel lips 102, 104, ridges 106, 108, washers 110 and screws 112. The outside dimensions of cover-spacer 30 preferably are about 27 to 29 inches long by about 12 to 14 inches wide by about 4 and ¼ inches high. Preferably the height of cover-spacer 30 is proportioned to be sufficient to cover and close repository 20 and to be about ¼ to ⅜, most preferably, about ⅓, of the total height of closed casket 10. Preferably, about 1/16 inch of clearance or gap should be provided between the inside of each end of the cover-spacer and the outside of each end wall 60, 62. Preferably, about ⅛ inch of clearance or gap should be provided between the inside of each longitudinal panel 94, 96 of cover-spacer 30 and the outside of front and rear walls 40, 44 of repository 20. These clearances or gaps provide secure and snug fit while permitting opening and closing when desired.

Slidable engagement of end panels 94, 96 of cover-spacer 30 over the approximately three inch height of risers 64, 66 and, to a lesser extent, of longitudinal panel lips 102, 104 over the top ¾ inch of front wall 40 and rear wall 44, in cooperation with magnets 120 and washers 110, provide secure but releasable covering and closure for repository 20.

Each end wall 60, 62 is provided with a handle 124, 126. Handles 124, 126 preferably are rounded, external, inverted, and generally patch-pocket-shaped. End wall 60 preferably is cut away or curved inwardly between points FG and also between points HA, see FIG. 1. End wall 62 similarly is cut away or curved inwardly between points BC and also between points DE. Preferably, the radius of curvature is about three to four inches. As a result of this geometry, a front viewing opening in the repository is provided as defined by the curved plane ABCH and a rear viewing opening by the curved plane EFGD. Each viewing opening preferably extends downwardly from riser tops 68, 70 in a proportion of about ¼ to ⅓ of the height of end wall 62 (including headboard or riser 66), which, in a preferred embodiment represents an opening of about three inches in elevation or about 3/11 of the height of end wall 62. Each viewing opening preferably extends substantially the entire length of repository 20.

Within the repository, a foam pad 140 underlies a preferably further padded satin lining 142 with skirt 144 topped by a satin pillow 146. A body of a deceased, which may be an infant, is placed on satin lining 142, with the infant's head supported by pillow 146 and preferably raised above the front and rear wall tops 42, 46 for better viewing through openings ABCH and EFGD, the risers 64, 66 extending above the infant's head in order to permit covering and closure by cover-spacer 30 without interference and without requiring repositioning of body or head. Each riser top 68, 70 preferably is about four inches long, which accommodates and is proportionate to the width of an infant's head.

In a preferred cradle-shaped embodiment, end walls 60, 62 are about 11 inches high from top to bottom, and the front and rear walls 40, 44 are about eight inches high from top to bottom. The top surface of the bottom panel 34 is about two inches above the bottom of the repository walls.

In a preferred embodiment, a burial casket according to the present invention comprises supports 150 comprising hips 152 and legs 154 which in a first mode support and elevate repository 20 in a first or elevated position and in a second mode permit the repository to rest in a second or unelevated position. Supports 150 comprising legs 154 and rocker-shaped feet 156 are extendable about two to four inches below the lowermost parts 50, 52, 54, 56 of repository 20. Rocker-shaped feet 156 preferably are about eight to ten inches, most preferably about nine inches, long from end 158 to end 158 and preferably are about 1 and ¼ inches wide. Supports 150 when extended preferably raise repository 20 about three inches in the first or elevated position above the second or unclevated position. Supports 150 preferably are hingedly attached through hips 152 via strap hinges 166 and wood screws 168 to bottom panel 34. Rocker-shaped feed 156 may be releasably screwed to bottom panel 34 with magnets 170 and corresponding washers 172.

Legs 154 preferably terminate in rocker-shaped feet 156 about eight to ten inches long, more preferably about nine inches long, permitting nesting of the feet within a bottom skirt spacer defined by the bottom panel 34 and the lowermost inner sides of four walls 40, 44, 60, 62. Each rocker-shaped foot 156 preferably has a flat bottom about six inches long and at least two supporting points thereby preventing rocking of the repository during a funeral service.

In a preferred embodiment, a casket 10 is provided comprising a repository 20 for receiving a body and a cover-spacer 30 which in a first mode underlies and supports repository 20 in a first or elevated position and in a second mode covers and closes the repository in a second or unelevated position for burial. The cover or cover-spacer 30 when in the covering and closing mode preferably is attached to the repository 20 by any of a number of well-known and conventional attaching means such as hinges, hooks, screws, clasps, nuts and bolts or the like. Most preferably, the attaching means is a set of magnets, preferably four magnets 120, with one magnet at the top of each of the four corners of the repository, each corner being at the intersection of two of adjoining walls 40, 44, 60, 62. The magnets releasably secure the cover 30 to the repository 20, the cover being provided with four washers 110 positioned to mate with the magnets.

Magnets 120 preferably are cylinder-shaped, about ½ inch in diameter and about ¼ inch thick, and are countersunk at opposite ends of front wall top 42 and rear wall top 46 flush with the wall tops. Steel washers 110, preferably about ¾ inch diameter and 1/16 inch think are mounted with wood screws 112 (the steel heads of which are countersunk flush with the washer surface) at opposite ends of horizontal ridges 106, 108 of cover-spacer 30, positioned so as to magnetically engage corresponding magnets 120. Each magnet-washer pair preferably exerts about one to two pounds of force when magnetically engaged. The total magnetic force should be sufficient to securely but releasably hold cover-spacer 30 into repository 20 when in a second (closed or burial) mode. In the preferred embodiment, the total magnetic force is sufficient to hold cover-spacer 30 in the closed position even when closed casket 10 is in an inverted (upside-down) position, which indicates that the cover-spacer is unlikely to become dislodged unintentionally during transport or burial of the closed casket. On the other hand, the total magnetic force preferably can be overcome by lifting cover-spacer 30 to break the magnetic seal between cover-spacer 30 and repository 20. In other words, the total magnetic force preferably is not sufficient to lift the weight of repository 20 which could undesirably result in unintentional lifting of the repository off a supporting structure when one lifts cover-spacer 30.

Supports 150 comprising legs 154 may be attached to the bottom of the repository 20 and in a first mode are extended downwardly from bottom panel 34. The legs 154 terminate preferably in rocker-shaped feet 156. Each rocker-shaped foot 156 preferably has at least two supporting points 162 in order to prevent rocking. Still more preferably, each rocker-shaped foot has a generally flat bottom 160 and two upturned distal ends 158. The two supporting points for each rocker-shaped foot may be provided in the form of rubber nibs 162. Preferably, hips 152 are attached to bottom panel 134 of repository 20 by means of strap hinges 116 thereby permitting legs 154 to rotate downwardly and outwardly in a first mode and inwardly and upwardly in a second mode.

Figure 9:
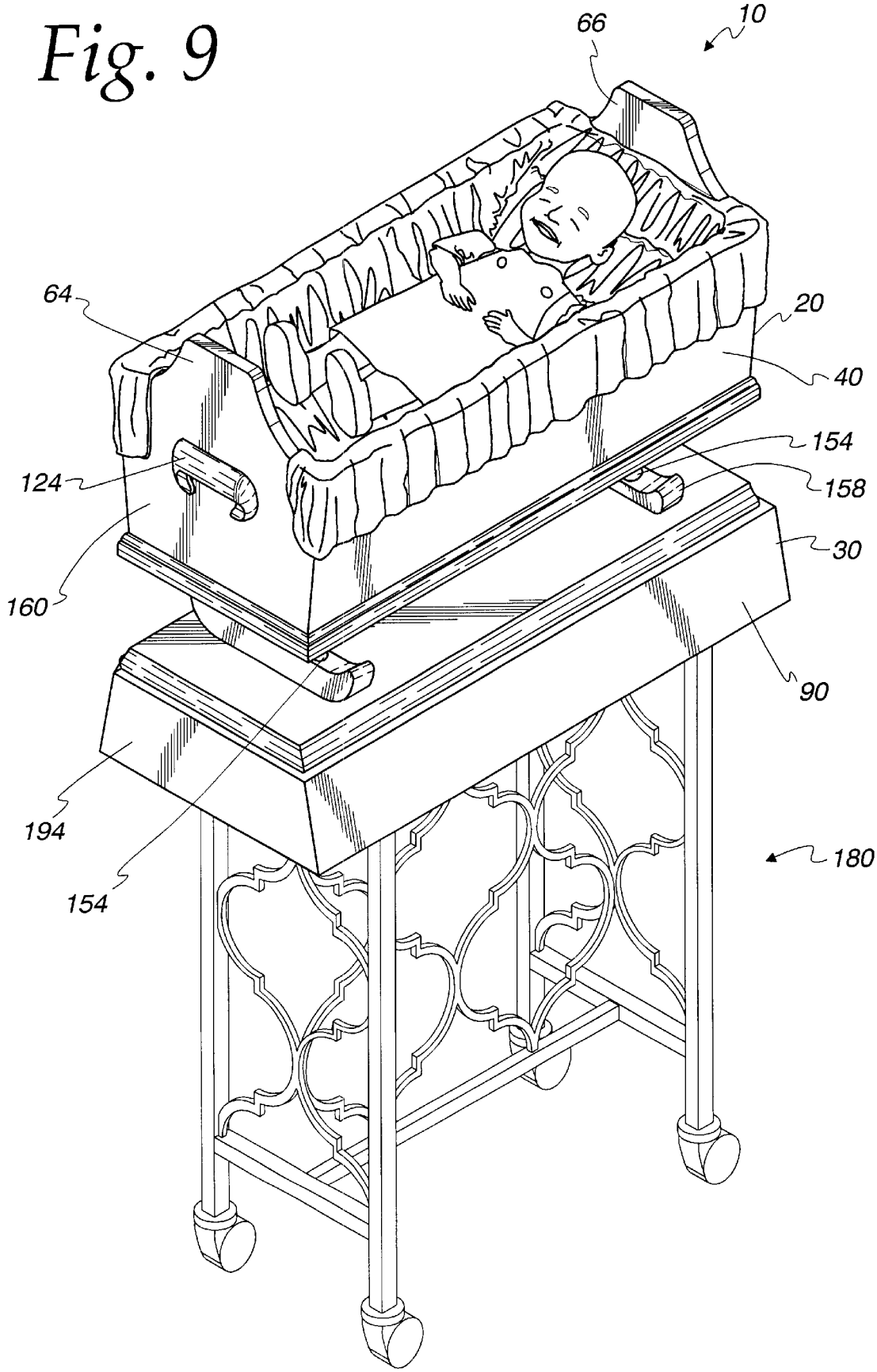
FIG. 9 is a perspective view of the open casket of FIG. 1 showing a traditional funeral service using a traditional standard baby carriage.
Figure 10:
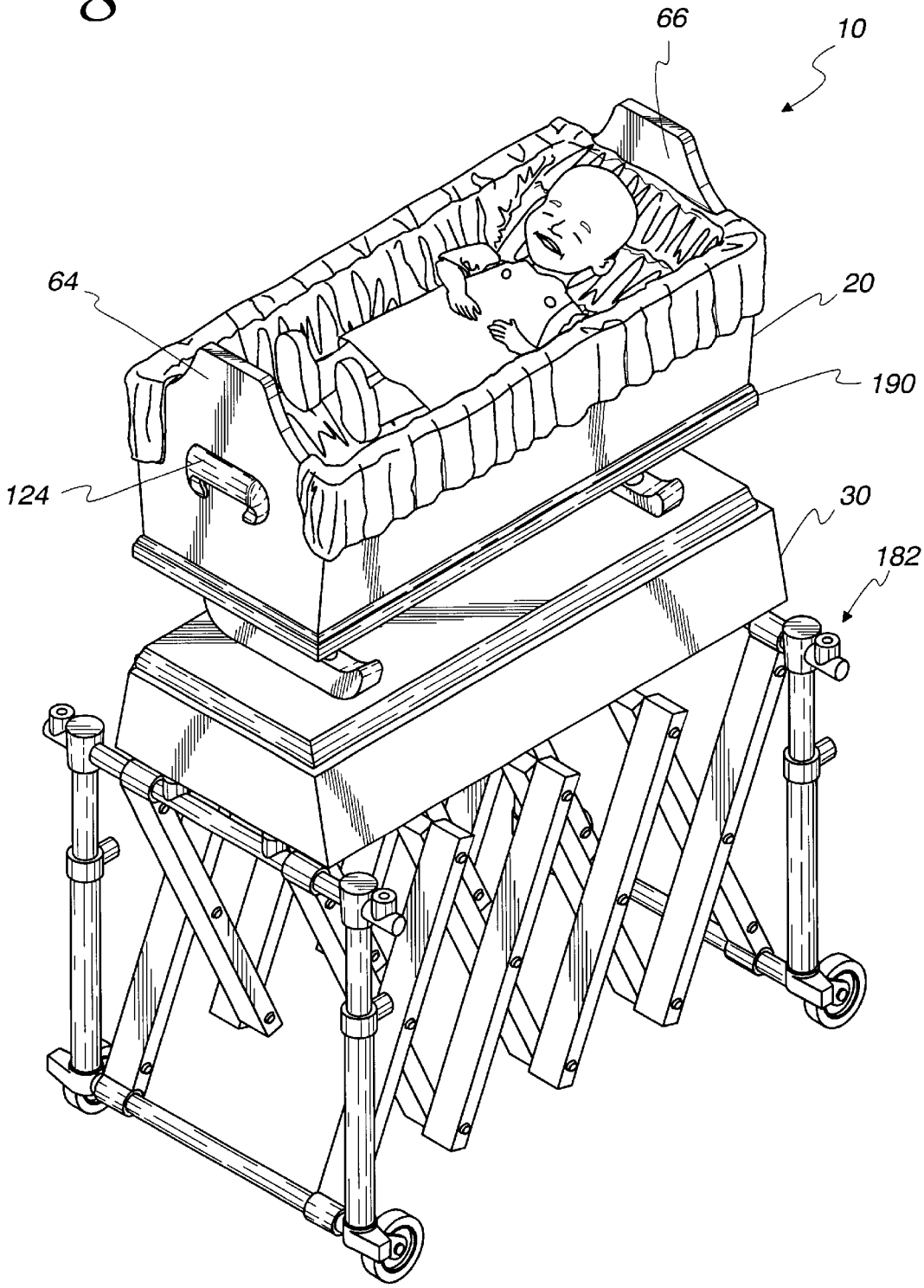
FIG. 10 is a perspective view of the open casket of FIG. 1 showing a traditional funeral service using a standard church truck.
Figure 11:
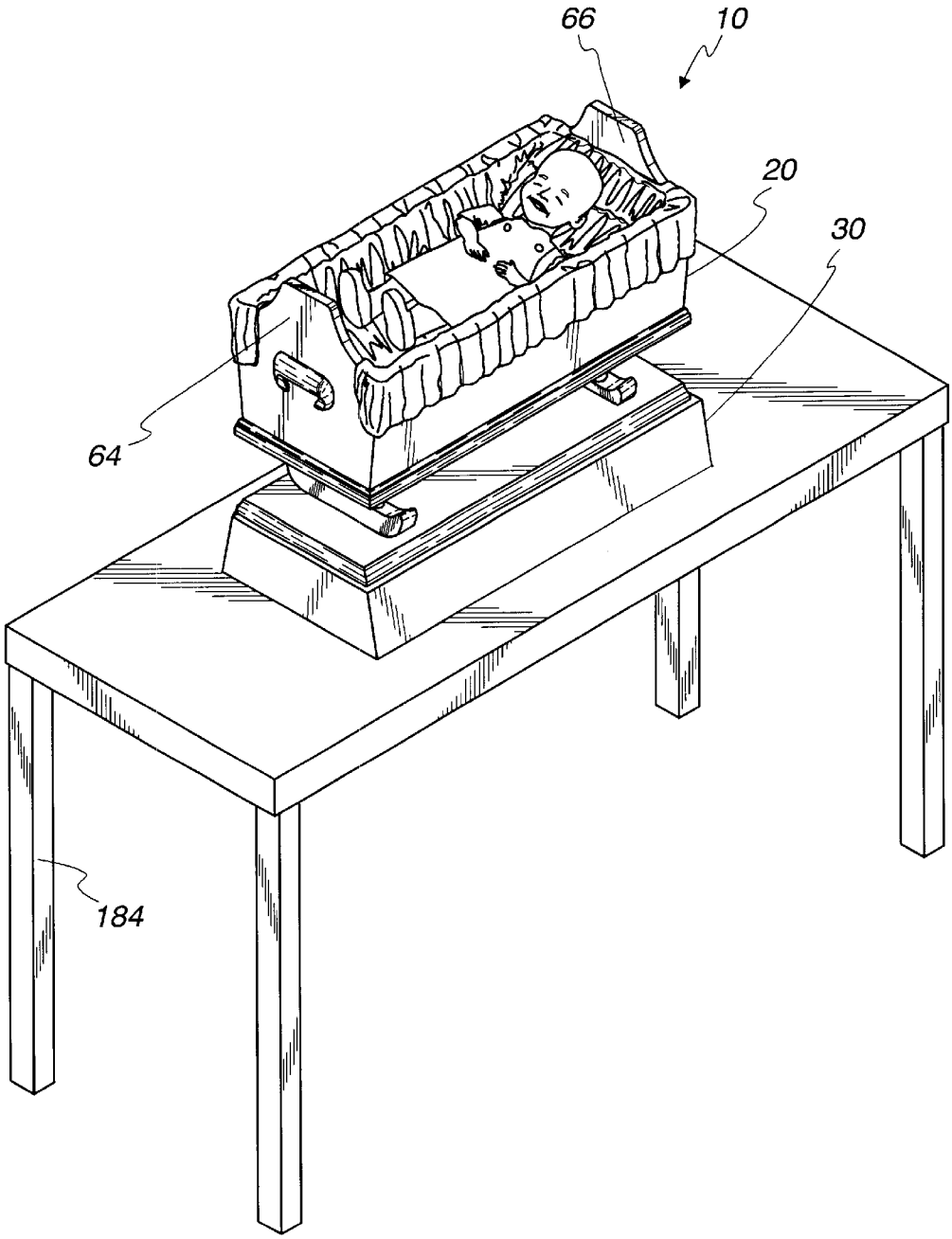
FIG. 11 is a perspective view of the open casket of FIG. 1 showing a traditional funeral service using a standard table.

In a first mode, the cover-spacer 30 is positioned on top of a selected supporting surface such as a standard baby carriage 180, a church truck 182, or a table 184, as for a funeral service, see FIGS. 9–11. The cover-spacer 30 serves as a support for elevating the repository into an elevated position for improved viewing of the body during the funeral service. The cover-spacer 30 is adapted to fit snugly and securely on the standard baby carriage 180, the church truck 182, or the table 184. In a second mode, the cover-spacer is placed on top of the repository where it fits snugly and closes the repository for burial, preferably secured through the use of four magnets 120 and four corresponding washers 110, each magnet-washer pair being placed in four opposite corners where repository 20 joins cover-spacer 30.

Handles 124, 126 are provided for handling of repository 20 whether in the covered or the uncovered mode.

Repository 20 preferably includes a foam mattress layer 140 and a padded satin lining 142 with skirt 144 which in a first mode may be draped outside the front and rear wall tops 42, 46 of repository 20 in order to provide a three inch or four inch curtain. A pillow 146 is provided to support the head of the body of the deceased which preferably is positioned above the plane defined by the top 42 of the front wall 40 and the top 46 of the rear wall 44. The riser or risers 64, 66 serve the function of elevating the cover-spacer 30, when in a second or closed mode, above all parts of the body of the deceased so that repository 20 can be closed without requiring repositioning the body.

In a preferred embodiment, a burial casket 10 according to the present invention comprises a two part system including a repository 20 and a cover-spacer 30. In a first mode of operation, the preferred repository 20 shows a cradle-shaped appearance in that there are elevated risers 64, 66 at both ends of the repository, the risers defining viewing openings ABCH and EFGD at the front wall 40 of the repository and the rear wall 44 of the repository in order to provide improved viewing lines for those in attendance at a funeral service. See FIG. 8. In the first mode, supports 150 comprising legs 154 are extended downwardly from the repository 20, terminating in rocker-shaped feet 156, in order to give a rocking cradle appearance to the repository. When extended, the supports 150 raise the repository about three inches. Also in the first mode, the cover-spacer 30 is positioned on a supporting structure such as a standard baby carriage 180, a church truck 182, or a table 148, and the repository 20 in its first mode is positioned on top of the cover-spacer 30.

When placed under repository 20, cover-spacer 30 raises the repository an additional 4 and ¼ inches, which combines with the supports for a total of about 7 and ¼ inches in elevating the repository above a supporting structure. Thus, the combination of extended supports 150 and subtending cover-spacer 30 raises repository 20 by about 50% to about 80% in terms of the height of the repository. In a preferred embodiment, repository 20 is about 11 inches high from riser top 70 to bottom 56 and the combined raising height provided by supports and cover-spacer represents about 7/11 of the height of the repository.

When lying in state, an infant's body rests about two to four inches, most preferably about three inches above the bottom panel 34 or about five inches above the bottom surfaces 50, 52, 54, 56 of walls 40, 44, 60, 62 and through the use of pillow 146, the infant's head rests about one to three inches higher than the rest of the body. When casket 10 is set up in a first or funeral service mode, at least the infant's face should be visible through viewing openings ABCH and EFGD, but the uppermost part of the infant's head should not extend above riser top 70 and preferably should be one to two inches below said riser top before closure for burial. Pillow 146 may be removed prior to closure if desired. The combination of extended supports 150 and subtending cover-spacer 30 raise the infant's body from a height of about five inches to about 12 inches above a supporting structure. This represents an increase in body elevation of about 140%, for substantially improved viewing of the body during a funeral service, particularly with additional improvement provided by viewing openings.

Figure 6:
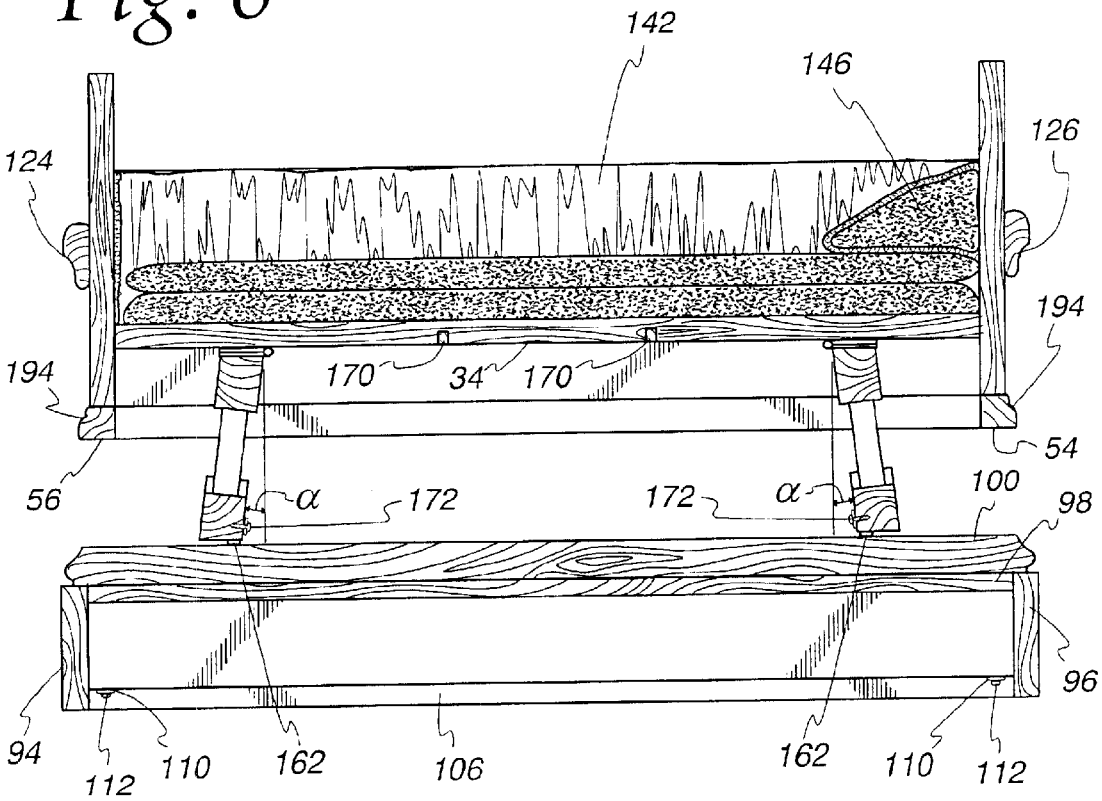
FIG. 6 is a cross-section of the open casket shown in FIG. 1, taken along lines 6—6.

The legs 154 of the repository 20, in the first mode, preferably are splayed by an angle alpha ($\alpha$) from the vertical about five to fifteen degrees, most preferably about seven degrees, outwardly from the vertical in order to provide stability for the repository in the first mode, see FIG. 6. Alternatively, the supports 150, preferably comprising legs 154 and rocker-shaped feet 156, may be releasably locked in an extended position through the use of a dowel (not shown) forcing the supports apart, or through other conventional releasable locking mechanisms. Two rubber nibs 162 preferably attached at the bottom of each rocker-shaped foot 156 allow for variations in the top surface or crown 100 of the cover-spacer and the bottom surface 160 of the rocker-shaped foot.

In a second mode, the casket 10 of the present invention is prepared for burial by folding the legs 154 inwardly and upwardly and placing the cover-spacer 30 on top of the repository 20. In the second mode, the casket 10 is suitable for placement within a standard infant burial vault 190 of dimensions typical for the babyland section of modern cemeteries.

The casket 10 may be provided with decorative features such as trim 100 on the top of the cover-spacer and trim 194 at the bottom of the repository 20. A favorite mobile may be affixed to the repository in the same manner as it would be affixed to a crib or a cradle. Other decorative features such as a cross or a star of David, not shown, may be provided within the scope of the invention. Preferably, a funeral service involving the present invention may provide for an optional blanket, such as a baby blanket (not shown), for covering all or part of the body of the deceased. The rocker-shaped feet 156 in the second mode may be releasably secured to the bottom of the repository by any conventional means such as hooks, screws, Velcro or the like, most preferably, by magnets 170. Magnets 170 have been found to be particularly suitable, reliable and convenient for releasable securing of the legs and rocker-shaped feet when in the second or burial mode.

The burial casket 10 of the invention is intended for use in the burials of humans and is particularly desirable for burial of infants, but it is also within the scope of the invention for use in burial of pets or other animals.

Repository 20 and cover-spacer 30 are preferably formed of wood, and still more preferably of alder. Other suitable materials such as metal, plastic or the like could be employed as well.

It further will be appreciated that the present invention provides a novel burial casket 10 which effectively provides improved viewing and display characteristics and appearance with a two part or two component system including a repository 20 and a cover-spacer 30. That is, the repository 20 having one or more risers 64, 66 extending upwardly from the repository results in an appearance of a headboard 66 or a headboard 66 and footboard 64 and most preferably a cradle-shaped appearance, in which a body of a deceased may be displayed and viewed advantageously with improved sight lines while at the same time providing for closure through the use of a cover 30 adapted to adjoin the riser tops 68, 70 and cover the repository.

It also will be appreciated that the present invention provides a novel burial casket 10 including a repository 20 and a cover 30 wherein the repository is mounted on retractable, collapsible or foldable legs 154 such that in a first mode the legs are extended and the repository is placed in a first or elevated position while in a second mode the legs are retracted, collapsed or folded placing the repository in a second or unelevated position.

Figure 7:
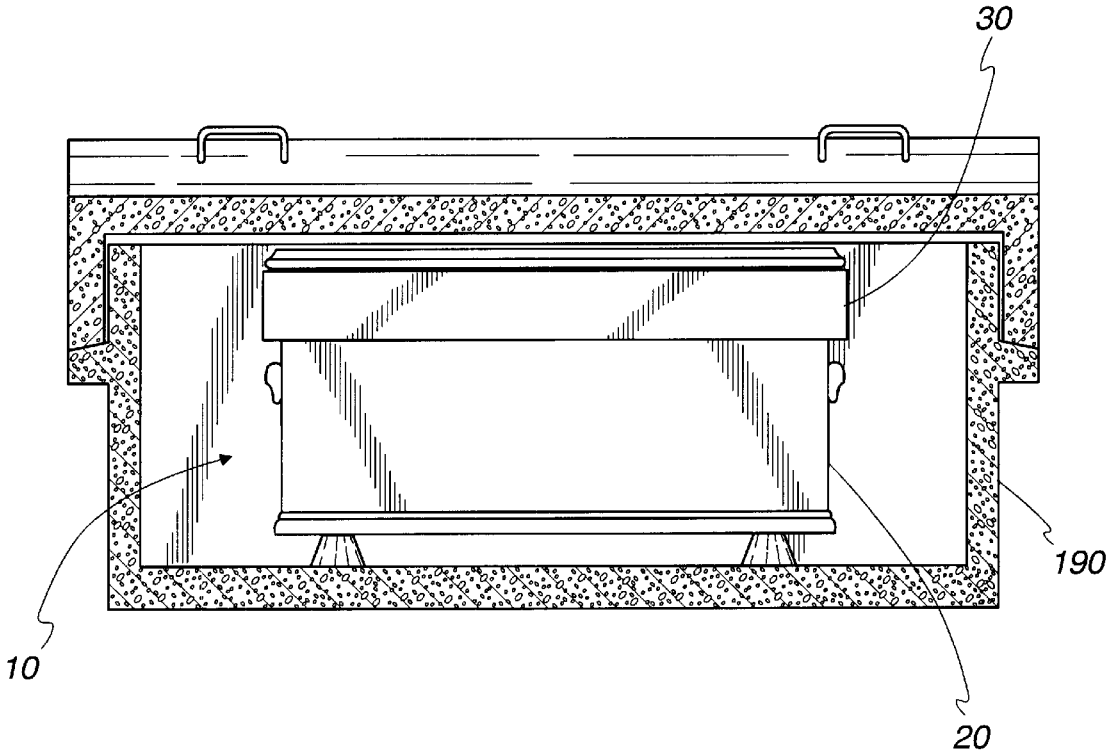
FIG. 7 is a front elevational view of the closed casket shown in FIG. 2, within a traditional burial vault.

It also will be appreciated that the present invention provides a novel burial casket 10 in which the appearance of a cradle is imparted through the use of rocker-shaped feet 156, preferably having two supporting points 162 for each foot thereby preventing actual rocking. In the present invention, the use of a dual purpose cover-spacer 30 permits one mode in which the cover-spacer underlies and supports the repository 20 in an elevated position while in a second mode the cover-spacer 30 adjoins riser top 68, 70 and covers and closes the repository. The cover-spacer 30 preferably fits over, surrounds and envelopes the risers 64, 66 and rests on the front and rear walls 40, 44 of the repository thereby providing a snug and secure fit, particularly with the preferred use of magnet closures 120 for releasably securing the cover-spacer to the top of the repository. The casket of invention enables it to be inserted into a typical standard infant burial vault 190, see FIG. 7, such as is provided in the babyland section of some modern cemeteries.

The uniquely profiled shape of the two part casket 10 provides for ease of use and assembly without the need for any additional parts and without any parts left over after burial. The uniquely profiled contour of the repository 20 and the profile of the cover-spacer 30 permit advantageous display and viewing without the need for an adjustable mattress support or the need for repositioning of the body for the funeral service or for the burial. The repository 20 is profiled so as to support a deceased in the traditional position of repose.

By employing a two component system, the burial casket 10 being formed of various parts, the components and the parts can be completely manufactured at a fabrication facility, i.e., fabricated, sanded, stained, etc. and shipped advantageously with minimal weight and space requirements, the weight and space being no more than the weight of the repository and the cover-spacer and the dimensions being those of the casket in the second, closed or burial mode, which is at its most compact.

Preferably, the total weight of casket 10, when made of wood and proportioned for an infant, is about 12 to 25 pounds, still more preferably, about 15 pounds. The compact dimensions of casket 10 when in a second (or closed) mode, together with its light weight, make it suitable for convenient packaging, shipping, delivery and handling.

The casket 10 of the invention may be shipped in a convention corrugated container preferably with Styrofoam protection shaped to fit the container and the contour of the casket, but other packing materials such as bubble wrap or the like, and other packing techniques, may be used.

Although the invention has been described in connection with preferred embodiments thereof, it will be appreciated by those skilled in the art, that additions, modifications, substitutions and deletions not specifically described, may be made without departing from the spirit or scope of the invention as defined in the appended claims.

I claim:

1. A casket comprising:

a repository for receiving a body for viewing and burial;

the repository having a bottom, a front wall with a top, a rear wall and two end walls;

at least one of the end walls having a riser extending upwardly from the one end wall;

the riser having a top which is higher than the top of the front wall for improved viewing of the body; and a cover adapted to fit over the riser top and to cover the repository without interference with the body.

2. A casket as in claim 1, further comprising legs mounted to the repository, the legs having rocker-shaped feet.

3. A casket as in claim 1, wherein the riser has a height, wherein the front wall has a height, and wherein the height of the riser is between about 30% and about 60% higher than the height of the front wall.

4. A casket as in claim 1, further comprising legs mounted to the repository, the legs being movable between an extended mode and a retracted mode.

5. A casket as in claim 1, wherein the body is an infant body and wherein the repository is sized to accommodate the infant body for viewing and burial.

6. A cradle-shaped casket for viewing and burial of an infant, comprising:

a repository for receiving a body;

the repository having a bottom, a front wall, a rear wall and two end walls;

the front wall including a top and wherein at least one of the end walls has a riser extending upwardly from the one end wall, the riser having a top which is higher than the top of the front wall;

a cover adapted to cover the repository; and legs mounted to the repository, the legs being movable between an extended mode and a retracted mode;

wherein the legs include at least one rocker-shaped foot, the rocker-shaped foot having a generally flat bottom, thereby preventing rocking.

7. A casket as in claim 6, wherein each foot has two supporting points.

8. A casket as in claim 6, wherein the riser has a height, wherein the front wall has a height, and wherein the height of the riser is between about 30% and about 60% higher than the height of the front wall.

9. A casket comprising:

a repository for receiving a body for viewing and burial;

the repository having a bottom, a front wall with a top, a rear wall, and two end walls;

at least one of the end walls having a riser extending upwardly from the one end wall;

the riser having a top which is higher than the top of the front wall;

legs mounted to the repository; and a cover-spacer which in a first mode underlies and supports the legs and the repository and in a second mode adjoins the riser top and covers the repository.

10. A casket as in claim 9, wherein the repository and cover-spacer can be inserted into a typical standard infant burial vault when the cover-spacer is in the second mode.

* * * * *